US011591176B2

(12) United States Patent
de la Hoz Matveeva

(10) Patent No.: US 11,591,176 B2
(45) Date of Patent: Feb. 28, 2023

(54) CONVERTIBLE PRINTED PRODUCT COLLECTING ASSEMBLY

(71) Applicant: Hewlett-Packard Development Company, L.P., Spring, TX (US)

(72) Inventor: Bladimir de la Hoz Matveeva, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 58 days.

(21) Appl. No.: 16/977,944

(22) PCT Filed: Mar. 27, 2018

(86) PCT No.: PCT/US2018/024590

§ 371 (c)(1),
(2) Date: Sep. 3, 2020

(87) PCT Pub. No.: WO2019/190479

PCT Pub. Date: Oct. 3, 2019

(65) Prior Publication Data

US 2021/0009377 A1 Jan. 14, 2021

(51) Int. Cl.

| | |
|---|---|
| ***B65H 31/22*** | (2006.01) |
| ***B65H 31/20*** | (2006.01) |
| ***B41J 13/10*** | (2006.01) |

(52) U.S. Cl.

CPC ..... *B65H 31/20* (2013.01); *B41J 13/106* (2013.01); *B65H 2401/14* (2013.01); *B65H 2701/11312* (2013.01); *B65H 2801/36* (2013.01)

(58) Field of Classification Search

CPC .. B65H 2701/11312; B65H 2405/1116; B65H 2801/36; B65H 2301/16;

(Continued)

(56) References Cited

U.S. PATENT DOCUMENTS

| | | | |
|---|---|---|---|
| 4,936,698 | A | 6/1990 | Clyburn |
| 5,188,352 | A | 2/1993 | Bartman |

(Continued)

FOREIGN PATENT DOCUMENTS

| | | |
|---|---|---|
| CN | 1433892 | 8/2003 |
| CN | 2895056 | 5/2007 |

(Continued)

OTHER PUBLICATIONS

Epson Stylus Photo 960 Reference Guide, Attaching the Photo Basket, 2001, Seiko Epson Corporation, <https://files.support.epson.com/htmldocs/pho960/pho960rf/acut_2.htm>.

(Continued)

*Primary Examiner* — Luis A Gonzalez

(57) ABSTRACT

A convertible printed product collecting assembly (10) includes a collecting fabric (11) rolled on a rotatable fabric bearing rod. Supporting legs (13) have a lower end tiltably connected to a printer (18) and are tillable in the collecting fabric's longitudinal direction. A tensioning and locking mechanism (15, 16) is arranged to release or to lock the fabric bearing rod to rotate. Stabilizing brackets (14) secure the supporting legs (13) in at least one tilting angle. The tensioning and locking mechanism (15, 16) is operable to tension and to hold the collecting fabric (11) in a flat, tensioned shape when in the locking state so as to provide a receiving desk for the printed product. Further, the collecting fabric (11) forms a collecting bag when unreeled from the fabric bearing rod.

15 Claims, 5 Drawing Sheets

(58) Field of Classification Search
CPC ..... B65H 31/02; B65H 31/00; B65H 31/22; B65H 31/20; B65H 2401/14; B41J 13/106
See application file for complete search history.

(56) References Cited

U.S. PATENT DOCUMENTS

| | | | | |
|---|---|---|---|---|
| 5,924,808 | A | 7/1999 | Sides, II | |
| 6,428,000 | B1 | 8/2002 | Hara | |
| 6,830,401 | B1 | 12/2004 | Hwang et al. | |
| 7,237,969 | B2 | 7/2007 | Bartman | |
| 7,568,694 | B2 | 8/2009 | Sparer et al. | |
| 8,177,213 | B2 | 5/2012 | Hirabayashi | |
| 2008/0213024 | A1 | 9/2008 | Kaisha | |
| 2011/0024975 | A1* | 2/2011 | Saito ..... | B65H 31/02 271/207 |
| 2015/0266695 | A1 | 9/2015 | Aoyagi | |
| 2017/0088383 | A1 | 3/2017 | Anayama et al. | |
| 2017/0088384 | A1 | 3/2017 | Asai | |

FOREIGN PATENT DOCUMENTS

| | | |
|---|---|---|
| CN | 101279547 | 10/2008 |
| CN | 103373088 | 10/2011 |
| CN | 102909967 | 2/2013 |
| CN | 106553925 | 4/2017 |
| CN | 206287676 | 6/2017 |
| CN | 107284029 | 10/2017 |
| JP | 59018886 | 1/1984 |
| JP | 2005114072 | 4/2005 |
| JP | 2005157158 | 6/2005 |
| JP | 2007-62977 | 3/2007 |
| JP | 2013-230882 | 11/2013 |
| JP | 2014-189344 | 10/2014 |
| JP | 2015-180583 | 10/2015 |
| JP | 015182842 | 10/2015 |
| JP | 2017-39566 | 2/2017 |
| JP | 2017-64991 | 2/2017 |
| JP | 2017065844 | 4/2017 |
| WO | WO-2015185119 A1 | 12/2015 |

OTHER PUBLICATIONS

IPF Solutions, 44"' Canon imagePROGRAF Pro-4000S WF, Canon, accessed online Jan. 24, 2018 <https://www.ipfsolutions.uk/printer/40-canon-pro-4000s-wf/>.

* cited by examiner

CONVERTIBLE PRINTED PRODUCT COLLECTING ASSEMBLY

BACKGROUND

Printers have an output where a printed product leaves the printer. Typically, the printed product is a sheet material of a given material and size. A printed product collecting assembly is to collect the printed product from the output of the printer. Among others the printed product is collected on a flat surface or it can be collected in a bag formed by a fabric material. The printed product can be a single sheet, or multiple sheets can be collected in a stack.

BRIEF DESCRIPTION OF THE DRAWINGS

The accompanying drawings illustrate various examples of the principles described herein and are a part of the specification. The illustrated examples are given merely for illustration, and do not limit the scope of the claims.

FIGS. 5*a* and 5*b* are slightly simplified perspective partial views of a detail of a tensioning and locking mechanism which is to reel, unreel and tension the fabric of the printed product collecting assembly, similar as shown in FIG. 4, wherein FIG. 5*a* illustrates the tensioning and locking mechanism in a releasing state in which the tensioning and locking mechanism is operable to release and unreel the collecting fabric from the fabric bearing rod, and FIG. 5*b* illustrates the tensioning and locking mechanism in a locking state in which the tensioning and locking mechanism is operable to tension the collecting fabric and to hold the collecting fabric in a flat, tensioned shape.

Throughout the drawings, identical reference numbers designate similar, but not necessarily identical, elements.

DETAILED DESCRIPTION

Figure 1:
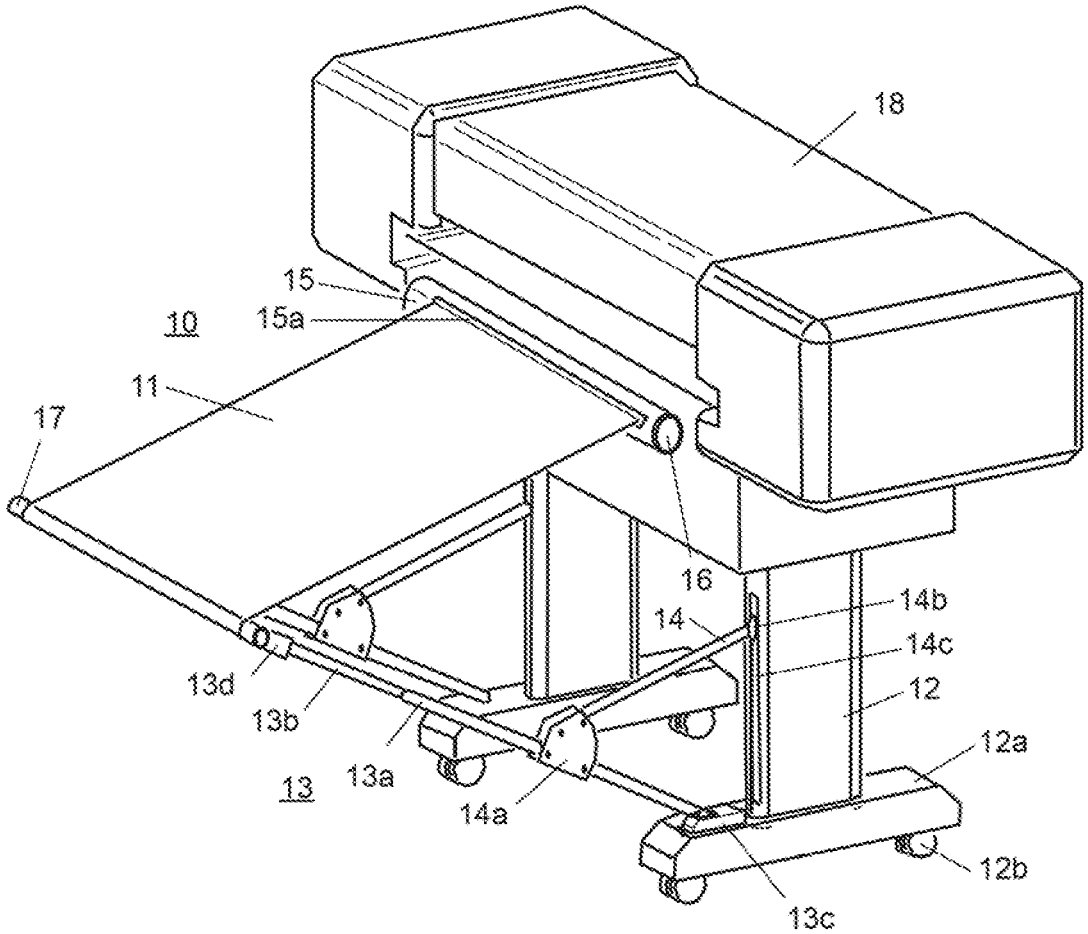
FIG. 1 is a slightly simplified perspective illustration of a printer which has a printed product collecting assembly according to one example, wherein the printed product collecting assembly is shown in a configuration where a collecting fabric is in a flat, tensioned shape.

FIG. 1 illustrates a printer 18 which has a printed product collecting assembly 10 according to one example. The convertible printed product collecting assembly 10 includes a collecting fabric 11 which has a longitudinal and a transversal direction.

Figure 5A:
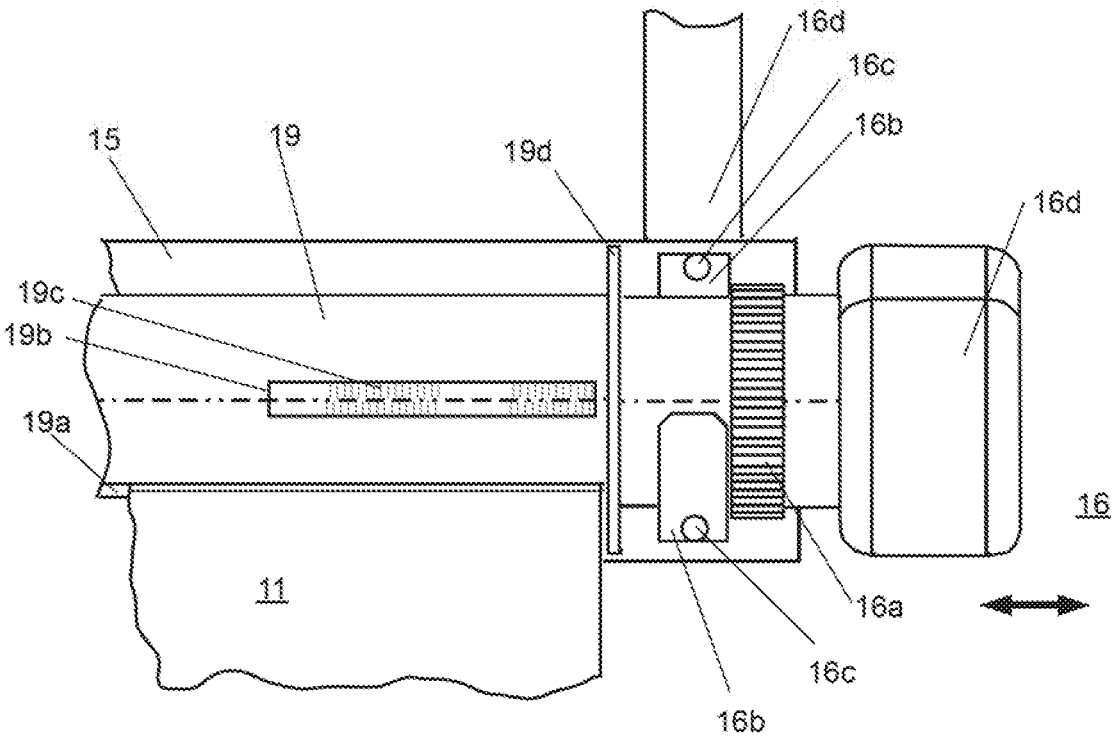
Figure 5B:
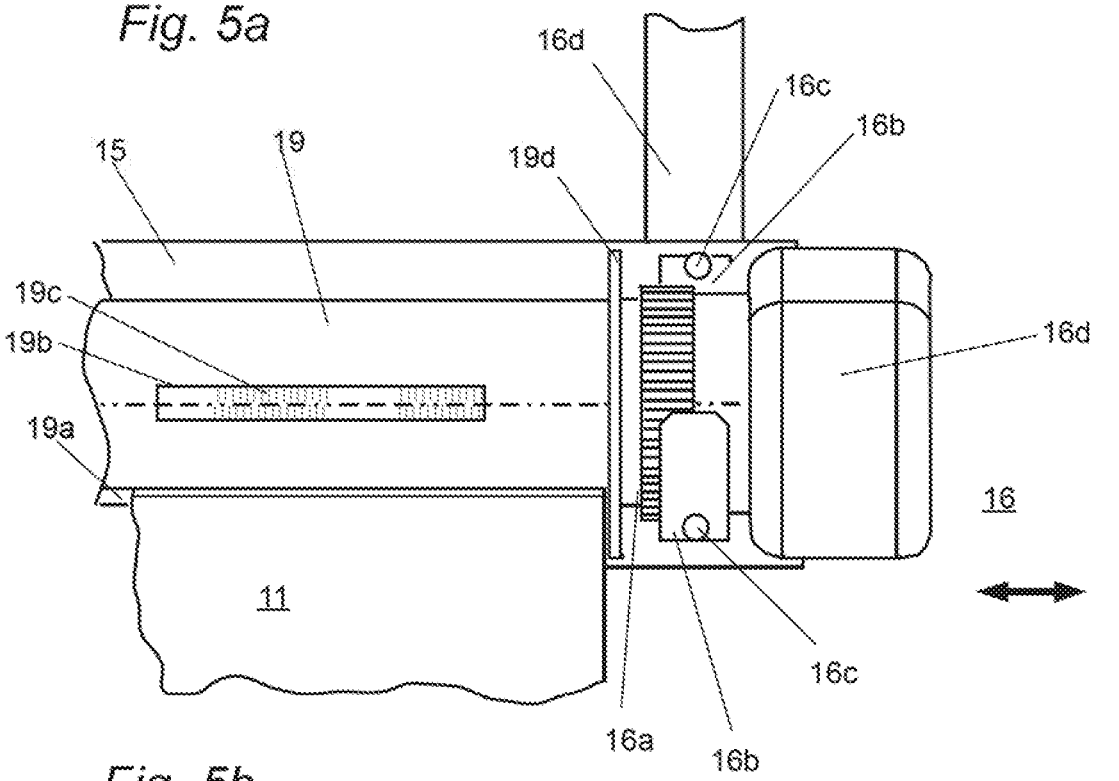

As illustrated in detail in FIGS. 5*a*, 5*b*, the collecting fabric 11 is fixed at one end, in its longitudinal direction, to and rolled on a rotatable fabric bearing rod 19 which extends in the transversal direction of the fabric. In the example of FIGS. 5*a*, 5*b* the fabric bearing rod 19 is coupled to a tensioning and locking mechanism 15, 16 which is operable to tension the collecting fabric 11 and to hold the collecting fabric 11 in a flat, tensioned shape, as wilt be described later.

Returning to the example of FIG. 1, the collecting fabric 11 is fixed at its other end to a transversal fixation rod 17. The collecting fabric 11 is to receive the printed product from a printer output. The printed product from the printer may be, e.g., a sheet material of a given material and size Generally spoken, the printed product collecting assembly 10 is to collect the printed product from the output of the printer, wherein, among others, the printed product can be collected on a flat surface formed by the collecting fabric 11, or it can be collected in a bag which is also formed by the fabric 11. The printed product can be for example, a single sheet, or multiple sheets that may be collected in a stack.

Figure 1A:
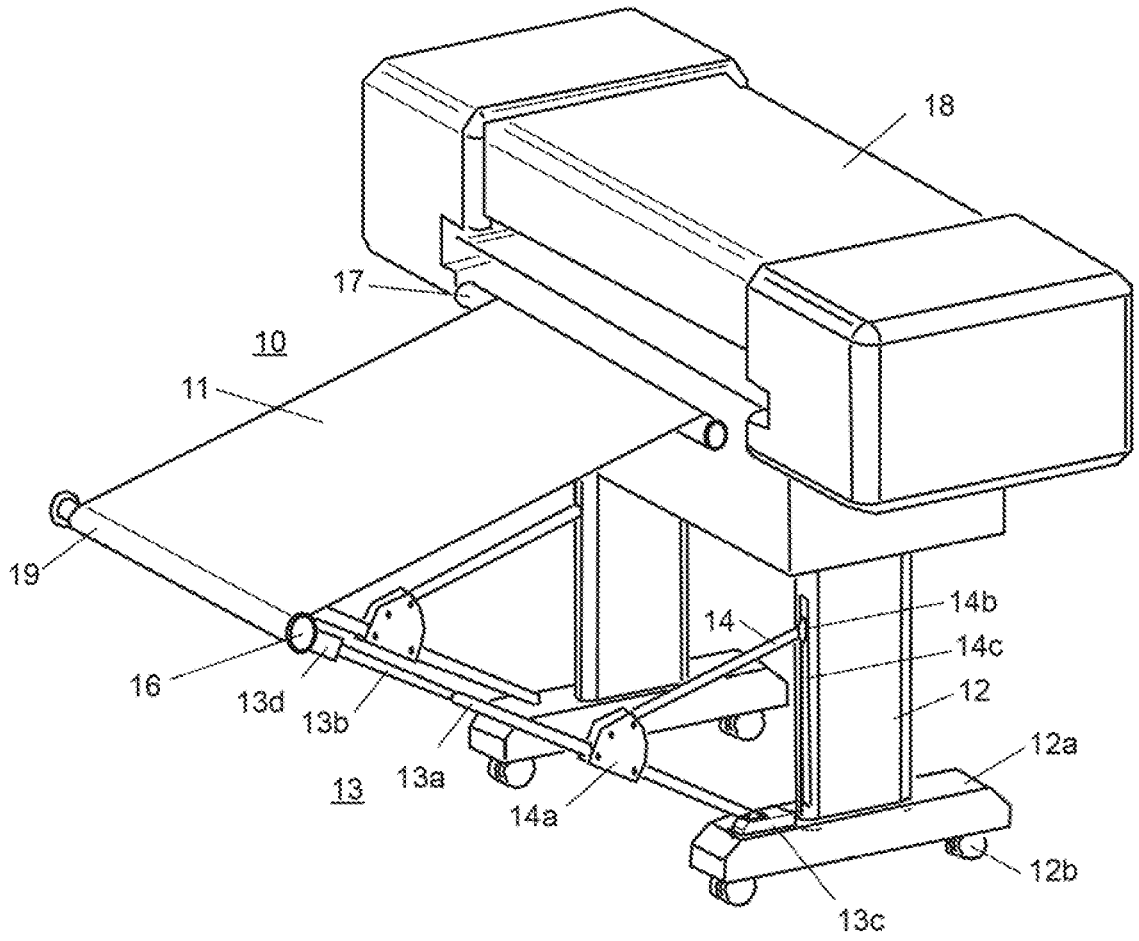
FIG. 1A is a perspective view of a printer which has a printed product collecting assembly according to another example, wherein the printed product collecting assembly is shown in a configuration where a collecting fabric is in a flat, tensioned shape.

In an example, as illustrated in FIG. 1, the printed product collecting assembly 10 has supporting legs 13 which are connected to the printer 18, in particular to a printer supporting base 12, and which are tiltable in the collecting fabric's longitudinal direction. In an example, the supporting legs 13 have hinge members 13*c* located on at least one of its ends, e.g., at the lower end to be mounted at the printer supporting base 12, so that the supporting legs 13 are tiltable relative to the hinge members 13*c* in the collecting fabric's 11 longitudinal direction. In the example of FIGS. 1, 1A, the printer supporting base 12 has a transverse foot member 12*a* which is mounted on swivel castors 12*b*.

Further, in an example and as illustrated in FIGS. 1, 1A, the supporting legs 13 are telescopic legs which include first and second telescopic parts 13*a*, 13*b*, the supporting legs 13 being tiltable in the collecting fabric's longitudinal direction. The lower end of the first telescopic part 13*a* is connected to the hinge member 13*c*. In the example of FIG. 1, the upper end of second telescopic part 13*b* is connected to support the transversal fixation rod 17. On the other hand, in the example of FIG. 1A, the upper end of second telescopic part 13*b* is connected the fabric bearing rod 19 with an associated tensioning and locking mechanism 16.

Figure 2:
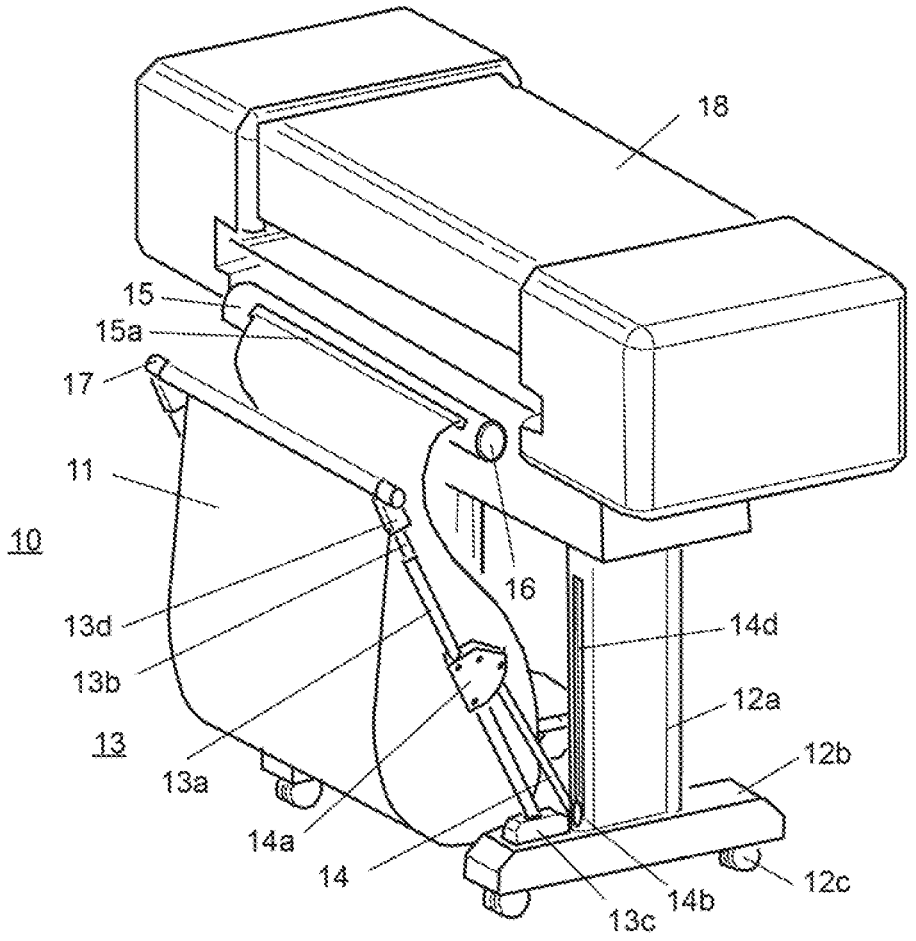
FIG. 2 is a perspective view of a printer which has a printed product collecting assembly according to one example, similar as in FIG. 1, wherein the printed product collecting assembly is shown in a configuration where the collecting fabric forms a collecting bag.

Stabilizing brackets 14 are coupled to the supporting legs 13. In an example, as illustrated in FIGS. 1, 1A, 2, the stabilizing brackets 14 are stabilizer arms which are at one end connected to the supporting leg 13 and which are at the other end connected to the printer supporting base 12, wherein the stabilizer arms 14 are connected by a hinge element 14*a* to the supporting legs 13.

In an example, the stabilizing arms 14 are slidingly attached in a longitudinal direction of the supporting legs 13. In an example, the stabilizing arms 14 are slidingly attached in a longitudinal direction of an elongate rail 14*c* extending on the printer supporting base 12. In another example, the stabilizing arms 14 are slidingly attached in both: the longitudinal direction of the supporting legs 13; and the longitudinal direction of an elongate rail 14*c* extending on the printer supporting base 12. In an example, the stabilizer arms 14 are connected by another hinge element 14*b* to the printer supporting base 12 or to the elongate rail 14*c* extending on the printer supporting base 12, so as to accommodate tilting movement of the supporting legs 13 relative to the printer supporting base 12.

The tensioning and locking mechanism 15, 16 of FIG. 1 is associated to the fabric bearing rod 19 to rotate the fabric bearing rod 19, thereby releasing the fabric bearing rod 19 to rotate in a releasing state and to lock the fabric bearing rod 19 against rotation in a locking state. In a similar way, the tensioning and locking mechanism 16 of FIG. 1A, which has not the tube 15 in me example shown in FIG. 1A, is associated to the fabric bearing rod 19 to rotate the same releasing the fabric bearing rod 19 to rotate in a releasing state and to lock the fabric bearing rod 19 against rotation in a locking state.

In general, one of the fabric bearing rod 19 with its associated tensioning and locking mechanism 15, 16 (FIG. 1) or 15 (FIG. 1A) and the transversal fixation rod 17 is connected to and supported by upper ends of the supporting legs 13, and the other is to be arranged close to the printer 18 output.

In an example, as illustrated in FIGS. 1 and 2, the fabric bearing rod 19 with its associated tensioning and locking mechanism 15, 16 is arranged close to the printer 18 output, and the transversal fixation rod 17 is connected to and supported by upper ends of the supporting legs 13.

In another example, as illustrated in FIG. 1A, the fabric bearing rod 19 with its associated tensioning and locking mechanism 16 is connected to and supported by upper ends of the supporting legs 13, and the transversal fixation rod 17 is arranged close to the printer 18 output.

In an example, as illustrated in FIGS. 1 and 2, the tensioning and locking mechanism 15, 16 includes a tube 15, in which the fabric bearing rod 19 is rotatably mounted, and wherein the tube 15 has an elongate slot or opening 15*a*, extending in the fabric's 11 transversal direction, through which the fabric 11 exits the tube 15.

In an example, the tensioning and locking mechanism 15, 16 includes a tube 15 in which the fabric bearing rod 19 is rotatably mounted. In an example as shown in FIG. 1 the tensioning and locking mechanism 15, 16 is operative in that it optionally releases or locks rotation between an end of the tube 15 and the fabric bearing rod 19.

Figure 4:
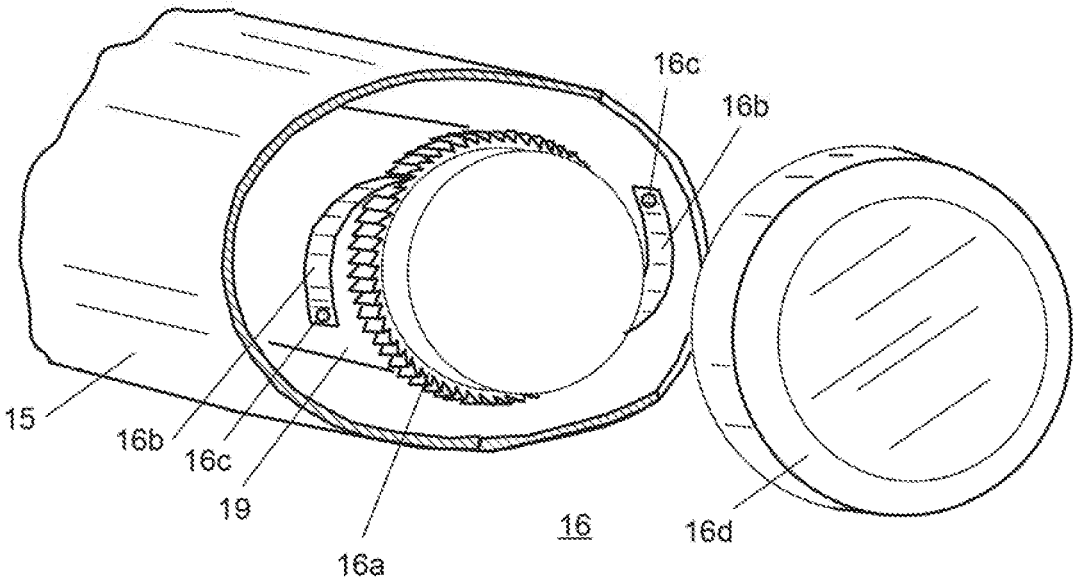
FIG. 4 is a slightly simplified perspective partial view of a detail of a printed product collecting assembly according to one example, which illustrates a tensioning and locking mechanism which is to reel, unreel and tension die fabric relative to a fabric bearing rod of the printed product collecting assembly.

In an example, as illustrated in FIGS. 4, 5*a*, 5*b*, the tensioning and locking mechanism 15, 16 includes a toothed wheel 16*a* connected to an end of the fabric bearing rod 19, and one or more arcuate leaf springs 16*b* connected to the tube 15 by fastening elements which are schematically illustrated at 16*c*.

In the illustrated example, the toothed wheel 16*a* and the at least one leaf spring 16*b* are displaceable relative to each other in the longitudinal direction of the fabric bearing rod 19 so that in a first relative position the toothed wheel 16*a* and the at least one leaf spring 16*b* are engaging each other in a locking state to lock the fabric bearing rod 19 against rotation in a sense of rotation in which the fabric 11 would become slack, i.e. the toothed wheel 16*a* and the at least one leaf spring 16*b* cooperate in a ratchet type manner. In a second relative position the toothed wheel 16*a* and the at least one leaf spring 16*b* are disengaged from each other in a releasing state to release the fabric bearing rod 19 to rotate in any direction.

In an example, the toothed wheel 16*a* is connected to an actuating knob 16*d* protruding from one end of the tube 15. The toothed wheel 16*a* is displaceable relative the at least one leaf spring 16*b* between said first and second relative positions by moving the actuating knob 16*d* in the longitudinal direction of the fabric bearing rod 19. Additionally, in an example, a spring 19*c* may be accommodated in an interior cavity 19*b* in the fabric bearing rod 19, which spring 19*c* is to bias the rotation of the rod 19 in one direction.

In an example, one actuating knob 16*d* is provided on each end of the fabric bearing rod 19, the actuating knobs 16*d* both being coupled to the toothed wheel 16*a* so that the latter is displaceable in the longitudinal direction of the fabric bearing rod 19 by each of the actuating knobs 16*d*.

The tensioning and locking mechanism 15, 16 is operable to tension the collecting fabric 11 and to hold the same in a flat, tensioned shape when the tensioning and locking mechanism 15, 16 is in the locking state, as illustrated by FIGS. 1 and 1A.

On the other hand, the tensioning and locking mechanism 15, 16 is operable to release and unreel the collecting fabric 11 from the fabric bearing rod 19 to form a collecting bag, as shown in FIG. 2 for the example of FIG. 1. After forming the collecting bag the tensioning and locking mechanism 15, 16 might be brought into the locking state to prevent further unreeling of the fabric 11 from the fabric bearing rod 19, or, if the fabric 11 is completely unreeled from the fabric bearing rod 19, to which the fabric's longitudinal end is fixed, the tensioning and locking mechanism 16 may remain in the releasing state.

In the example of FIG. 1A, the collecting bag is formed in a similar way wherein the tensioning and locking mechanism 16 (which does not include the tube 15 in this example) is operable to release and unreel the collecting fabric 11 from the fabric bearing rod 19 and to form a collecting bag.

In an example, the stabilizing brackets or arms 14 are to secure the supporting legs in at least one tilting angle in which the collecting fabric 11 is at least partially unreeled from the fabric bearing rod 19.

In an example, the hinge member 13*c* which connects the lower end of the supporting legs 13 to the printer or printer base 12 is shaped to hold the supporting leg 13 in at least one tilting angle, tilted away from the printer.

Figure 3:
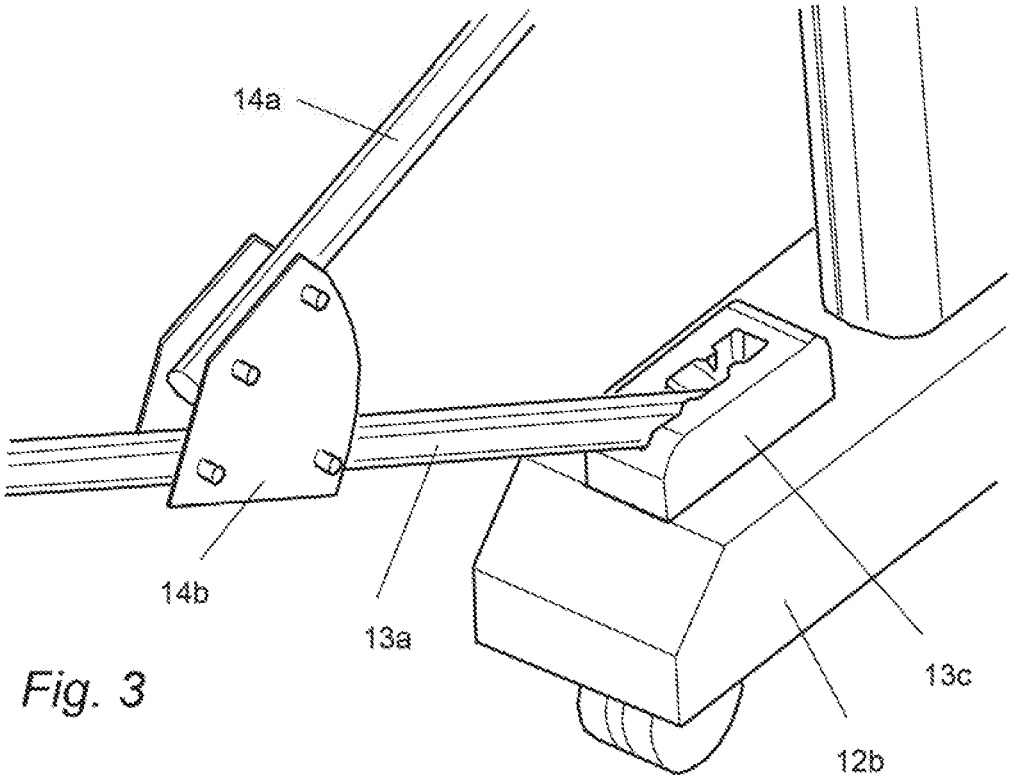
FIG. 3 is a slightly simplified perspective partial view of a detail of a printed product collecting assembly according to one example, which illustrates a supporting leg, a stabilizing bracket and a hinge member to be mounted on a printer.

In an example, as illustrated in FIG. 3, the hinge member 13*c* is shaped to hold the supporting leg 13 in three different tilting angles: one which is most tilted away from the printer 18 so that the collecting fabric 11 can be hold in a flat, tensioned shape, one which is intermediate so that the unreeled collecting fabric 11 can form the collecting bag, and one, close to the printer 18, which forms a stowing position for the convertible printed product collecting assembly 10.

What is claimed is:

1. A convertible printed product collecting assembly comprising:

a collecting fabric having a longitudinal and a transversal direction, the collecting fabric fixed at a first end in the longitudinal direction to and rolled on a rotatable fabric bearing rod extending in the transversal direction of the collecting fabric, the collecting fabric fixed at a second end to a transversal fixation rod, wherein the collecting fabric is to receive a printed product from a printer output;

supporting legs to tiltably connect to a printer and tiltable in the longitudinal direction of the collecting fabric;

stabilizing brackets coupled to the supporting legs; and a tensioning and locking assembly associated to the fabric bearing rod to release the fabric bearing rod to rotate in a releasing state and to lock the fabric bearing rod against rotation in a locking state, wherein a first rod of the fabric bearing rod with the associated tensioning and locking assembly and the transversal fixation rod is connected to and supported by upper ends of the supporting legs, and a second rod of the fabric bearing rod with the associated tensioning and locking assembly and the transversal fixation rod is to be arranged closer to the printer output than the first rod is, wherein the stabilizing brackets are to secure the supporting legs in at least one tilting angle in which the collecting fabric is at least partially unreeled from the fabric bearing rod, wherein the tensioning and locking assembly is operable to tension the collecting fabric and to hold the tensioned collecting fabric in a flat, tensioned shape when in the locking state, and wherein the tensioning and locking assembly is operable to release and unreel the collecting fabric from the fabric bearing rod to form a collecting bag.

2. The printed product collecting assembly of claim 1, in which wherein the fabric bearing rod with the associated tensioning and locking assembly is to be arranged closer to the printer output than the transversal fixation rod is, and the transversal fixation rod is connected to and supported by the upper ends of the supporting legs.

3. The printed product collecting assembly of claim 1, wherein the stabilizing brackets are to secure the supporting legs in first and second tilting angles, wherein in the first tilting angle the collecting fabric is to form a collecting bag when unreeled from the fabric bearing rod more than to form a flat, tensioned shape, and wherein in second tilting angle, when the tensioning and locking assembly is operated to tension the collecting fabric and when in the locking state, the collecting fabric forms the flat, tensioned shape.

4. The printed product collecting assembly of claim 1, wherein the supporting legs have hinge members at a lower end to be mounted at a printer supporting base, the supporting legs tiltable relative to the hinge members in the longitudinal direction of the collecting fabric.

5. The printed product collecting assembly of claim 1, wherein the fabric bearing rod with the associated tensioning and locking assembly is to be arranged closer to the printer output than the transversal fixation rod is, and the transversal fixation rod is connected to and supported by the upper ends of the supporting legs, wherein the tensioning and locking assembly includes a tube in which the fabric bearing rod is rotatably mounted, and wherein the tube has an elongate slot or opening extending in the transversal direction of the collecting fabric and through which the collecting fabric exits the tube.

6. The printed product collecting assembly of claim 1, wherein the tensioning and locking assembly includes a toothed wheel connected to an end of the fabric bearing rod and at least one arcuate leaf spring in a static position relative to the toothed wheel, and wherein the toothed wheel and the at least one arcuate leaf spring are displaceable relative to each other in a longitudinal direction of the fabric bearing rod so that in a first relative position the toothed wheel and the at least one arcuate leaf spring engage each other in the locking state to lock the fabric bearing rod against rotation in the locking state, and in a second relative position the toothed wheel and the at least one arcuate leaf spring disengage from each other in the releasing state to release the fabric bearing rod to rotate.

7. The printed product collecting assembly of claim 1, wherein the tensioning and locking assembly includes a tube in which the fabric bearing rod is rotatably mounted, wherein the tensioning and locking assembly is operatively arranged between an end of the tube and the fabric bearing rod, wherein the tensioning and locking assembly includes a toothed wheel connected to an end of the fabric bearing rod and at least arcuate leaf spring connected to the tube, and wherein the toothed wheel and the at least one arcuate leaf spring are displaceable relative to each other in a longitudinal direction of the fabric bearing rod so that in a first relative position the toothed wheel and the at least one arcuate leaf spring engage each other in the locking state to lock the fabric bearing rod against rotation in the locking state, and in a second relative position the toothed wheel and the at least one arcuate leaf spring disengage from each other in the releasing state to release the fabric bearing rod to rotate.

8. The printed product collecting assembly of claim 1, wherein the tensioning and locking assembly includes a tube in which the fabric bearing rod is rotatably mounted, wherein the tensioning and locking assembly is operatively arranged between an end of the tube and the fabric bearing rod, wherein the tensioning and locking assembly includes a toothed wheel connected to an end of the fabric bearing rod and at least one arcuate leaf spring connected to the tube, wherein the toothed wheel and the at least one arcuate leaf spring are displaceable relative to each other in a longitudinal direction of the fabric bearing rod so that in a first relative position the toothed wheel and the at least one arcuate leaf spring engage each other in the locking state to lock the fabric bearing rod against rotation in the locking state, and in a second relative position the toothed wheel and the at least one arcuate leaf spring disengage from each other in the releasing state to release the fabric bearing rod to rotate, wherein the toothed wheel of the tensioning and locking assembly is connected to an actuating knob protruding from the end of the tube, and wherein the toothed wheel is displaceable relative to the at least one arcuate leaf spring between the first and second relative positions by moving the actuating knob in the longitudinal direction of the fabric bearing rod.

9. The printed product collecting assembly of claim 1, wherein the tensioning and locking assembly includes a tube in which the fabric bearing rod is rotatably mounted, wherein the tensioning and locking assembly is operatively arranged between an end of the tube and the fabric bearing rod, wherein the tensioning and locking assembly includes a toothed wheel connected to an end of the fabric bearing rod and at least one arcuate leaf spring connected to the tube, wherein the toothed wheel and the at least one arcuate leaf spring are displaceable relative to each other in a longitudinal direction of the fabric bearing rod so that in a first relative position the toothed wheel and the at least one arcuate leaf spring engage each other in the locking state to lock the fabric bearing rod against rotation in the locking state, and in a second relative position the toothed wheel and the at least one arcuate leaf spring disengage from each other in the releasing state to release the fabric bearing rod to rotate, wherein the toothed wheel of the tensioning and locking assembly is connected to a first actuating knob protruding from one end of the tube, wherein the toothed wheel is displaceable relative to the at least one arcuate leaf spring between the first and second relative positions by moving the first actuating knob in the longitudinal direction of the fabric bearing rod, wherein second actuating knobs are each provided on a corresponding end of the fabric bearing rod, and wherein the second actuating knobs are both being coupled to the toothed wheel so that the toothed wheel is displaceable in the longitudinal direction of the fabric bearing rod by each of the second actuating knobs.

10. The printed product collecting assembly of claim 1, wherein the supporting legs are telescopic legs including first and second telescopic parts, the supporting legs are tiltable in the longitudinal direction of the collecting fabric, and an upper end of second telescopic part is connected to support the fabric bearing rod with the associated tensioning and locking assembly or the transversal fixation rod.

11. A printer having a convertible printed product collecting assembly which comprises:

a collecting fabric having a longitudinal and a transversal direction, the collecting fabric fixed at a first end in the longitudinal direction to and rolled on a rotatable fabric bearing rod extending in the transversal direction of the collecting fabric, the collecting fabric fixed at a second end to a transversal fixation rod, wherein the collecting fabric is to receive a printed product from a printer output;

supporting legs to tiltably connect to a printer and tiltable in the longitudinal direction of the collecting fabric;

stabilizing brackets coupled to the supporting legs; and a tensioning and locking assembly associated to the fabric bearing rod to release the fabric bearing rod to rotate in a releasing state and to lock the fabric bearing rod against rotation in a locking state, wherein a first rod of the fabric bearing rod with the associated tensioning and locking assembly and the transversal fixation rod is connected to and supported by upper ends of the supporting legs, and a second rod of the fabric bearing rod with the associated tensioning and locking assembly and the transversal fixation rod is to be arranged closer to the printer output than the first rod is, wherein the stabilizing brackets are to secure the supporting legs in at least one tilting angle in which the collecting fabric is at least partially unreeled from the fabric bearing rod, wherein the tensioning and locking assembly is operable to tension the collecting fabric and to hold the tensioned collecting fabric in a flat, tensioned shape when in the locking state, wherein the tensioning and locking assembly is operable to release and unreel the collecting fabric from the fabric bearing rod to form a collecting bag, wherein the supporting legs have a lower end connected by a hinge member mounted at a printer supporting base, the supporting legs being tillable by the hinge member in the longitudinal direction of the collecting fabric, wherein the hinge member is shaped to hold the supporting leg in at least one angular position tilted away from the printer supporting base, and wherein the upper end of the supporting leg is connected to support the fabric bearing rod with the associated tensioning and locking assembly or the transversal fixation rod.

12. The printer of claim 11, wherein the stabilizing brackets coupled to the supporting legs are stabilizer arms connected to the supporting legs at a first end and to the printer supporting base at a second end, and wherein the stabilizer arms are slidingly in either or both a longitudinal direction of the supporting legs or a longitudinal direction of an elongate rail extending on the printer supporting base, or both, so as to accommodate tilting movement of the supporting legs relative to the printer supporting base.

13. The printer of claim 11, wherein the stabilizing brackets coupled to the supporting legs are stabilizer arms connected to the supporting legs at a first end and to the printer supporting base at a second end, and wherein the stabilizer arms are connected by a hinge element to the supporting legs and are slidingly in either or both a longitudinal direction of the supporting legs or longitudinal direction of an elongate rail extending on the printer supporting base, and wherein the stabilizer arms are connected by another hinge element to the printer supporting base or to the elongate rail extending on the printer supporting base, so as to accommodate tilting movement of the supporting legs relative to the printer supporting base.

14. The printer of claim 11, wherein the fabric bearing rod with the associated tensioning and locking assembly is arranged closer to the printer output than the transversal fixation rod is, and the transversal fixation rod is connected to and supported by the upper ends of the supporting legs, and wherein the tensioning and locking assembly includes a tube in which the fabric bearing rod is rotatably mounted, and wherein the tube has an elongate slot or opening extending in the transversal direction of the collecting fabric and through which the collecting fabric exits the tube.

15. The printer of claim 11, wherein the tensioning and locking assembly includes a tube in which the fabric bearing rod is rotatably mounted, wherein the tensioning and locking assembly is operatively arranged between an end of the tube and the fabric bearing rod, wherein the tensioning and locking assembly includes a toothed wheel connected to an end of the fabric bearing rod and at least one arcuate leaf spring connected to the tube, wherein the toothed wheel and the at least one arcuate leaf spring are displaceable relative to each other in a longitudinal direction of the fabric bearing rod so that in a first relative position the toothed wheel and the at least one arcuate leaf spring engage each other in the locking state to lock the fabric bearing rod against rotation in the locking state, and in a second relative position the toothed wheel and the at least one arcuate leaf spring disengage from each other in the releasing state to release the fabric bearing rod to rotate, wherein the toothed wheel of the tensioning and locking assembly is connected to an actuating knob protruding from the end of the tube, and wherein the toothed wheel is displaceable relative to the at least one arcuate leaf spring between the first and second relative positions by moving the actuating knob in the longitudinal direction of the fabric bearing rod.

* * * * *